US011920218B2

(12) United States Patent
Mitropolskaya et al.

(10) Patent No.: US 11,920,218 B2
(45) Date of Patent: Mar. 5, 2024

(54) HIGH STRENGTH FASTENER STOCK OF WROUGHT TITANIUM ALLOY AND METHOD OF MANUFACTURING THE SAME

(71) Applicants: The Boeing Company, Chicago, IL (US); VSMPO-AVISMA Corporation, Verkhnyaya Salda (RU)

(72) Inventors: Natalia G. Mitropolskaya, Moscow (RU); Robert D. Briggs, Auburn, WA (US); Michael Leder, Verkhnyaya Salda (RU); Alexey Zaitsev, Verkhnyaya Salda (RU); Igor Puzakov, Verkhnyaya Salda (RU); Natalia Tarenkova, Verkhnyaya Salda (RU)

(73) Assignees: The Boeing Company, Arlington, VA (US); VSMPO-AVISMA Corporation, Verkhnyaya Salda (RU)

( * ) Notice: Subject to any disclaimer, the term of this patent is extended or adjusted under 35 U.S.C. 154(b) by 261 days.

(21) Appl. No.: 17/269,142

(22) PCT Filed: Aug. 31, 2018

(86) PCT No.: PCT/RU2018/000578
§ 371 (c)(1),
(2) Date: Feb. 17, 2021

(87) PCT Pub. No.: WO2020/046161
PCT Pub. Date: Mar. 5, 2020

(65) Prior Publication Data

US 2021/0310104 A1 Oct. 7, 2021

(51) Int. Cl.

| | |
|---|---|
| ***C21D 8/06*** | (2006.01) |
| ***C21D 9/52*** | (2006.01) |
| ***C22C 14/00*** | (2006.01) |

(52) U.S. Cl.
CPC ..... *C22C 14/00* (2013.01); *C21D 8/06* (2013.01); *C21D 9/525* (2013.01)

(58) Field of Classification Search
CPC ..... C21D 8/06; C21D 9/525; C22C 14/00; C22F 1/18
(Continued)

(56) References Cited

U.S. PATENT DOCUMENTS 5,160,554 A 11/1992 Bania et al.
10,471,503 B2 * 11/2019 Wright ..... C22F 1/183
(Continued)

FOREIGN PATENT DOCUMENTS

CN 102834537 12/2012
CN 105671366 6/2016
(Continued)

OTHER PUBLICATIONS

NPL: on-line translation of SU 555161 A1, May 1977 (Year: 1977).*
(Continued)

*Primary Examiner* — Jie Yang
(74) *Attorney, Agent, or Firm* — Walters & Wasylyna LLC

(57) ABSTRACT

This invention generally relates to the field of nonferrous metallurgy, namely to titanium alloy materials with specified mechanical properties for manufacturing the aircraft fasteners. A stock for high strength fastener is manufactured from wrought titanium alloy containing, in weight percentages, 5.5 to 6.5 Al, 3.0 to 4.5 V, 1.0 to 2.0 Mo, 0.3 to 1.5 Fe, 0.3 to 1.5 Cr, 0.05 to 0.5 Zr, 0.15 to 0.3 O, 0.05 max. N, 0.08 max. C, 0.25 max. Si, balance titanium and inevitable impurities, having the value of aluminum structural equivalent [Al] eq in the range of 7.5 to 9.5, and the value of molybdenum structural equivalent [Mo] eq in the range of
(Continued)

PROCESS FLOW CHART FOR A BAR STOCK FOR HIGH STRENGTH FASTENERS MADE OF WROUGHT TITANIUM ALLOY 6.0 to 8.5, where the equivalents are defined by the following equations: [Al] eq=[Al]+[O]×10+[Zr]/6; [Mo] eq=[Mo]+[V]/1.5+[Cr]×1.25+[Fe]×2.5. A manufacturing method for a stock for high strength fastener includes melting of titanium alloy ingot, production of forged billed from ingot at beta and/or alpha-beta phase field temperatures, hot rolling at a heating temperature of beta and/or alpha-beta phase field to produce a round stock, subsequent annealing of a rolled stock at a temperature of 550° C. to 705° C. (1022° F. to 1300° F.) for at least 0.5 hour followed by drawing to produce a wire with diameter up to 10 mm (0.394 inches) and subsequent annealing at a temperature of 550° C. to 705° C. (1022° F. to 1300° F.) for at least 0.5 hour. A technical result is production of a titanium alloy stock for high strength fastener having high ultimate tensile strength and double shear strength while maintaining a high level of plastic properties in the annealed condition.

20 Claims, 5 Drawing Sheets

(58) Field of Classification Search
USPC ..... 420/420
See application file for complete search history.

(56) References Cited

U.S. PATENT DOCUMENTS

| | | | | |
|---|---|---|---|---|
| 2003/0086772 | A1* | 5/2003 | Giannakakos | F16B 33/008 411/432 |
| 2012/0076611 | A1* | 3/2012 | Bryan | C22C 14/00 148/516 |
| 2016/0008903 | A1* | 1/2016 | Briggs | C22C 14/00 470/8 |
| 2017/0260607 | A1* | 9/2017 | Kosaka | C22C 14/00 |
| 2021/0164074 | A1* | 6/2021 | Mitropolskaya | B33Y 70/00 |

FOREIGN PATENT DOCUMENTS

| | | |
|---|---|---|
| EP | 2 435 591 | 4/2012 |
| EP | 2 527 478 | 11/2012 |
| EP | 3 196 321 | 7/2017 |
| RU | 2 436 858 | 12/2011 |
| SU | 555161 | 5/1977 |
| WO | WO 2017/156401 | 9/2017 |

OTHER PUBLICATIONS

Canadian Intellectual Property Administration, Office Action, U.S. Pat. No. 3,110,188, dated Jun. 22, 2022.
China National Intellectual Property Administration, Office Action, with English translation, App. No. 201880097056.X, dated Jan. 17, 2022.
China National Intellectual Property Administration, Office Action, with English translation, App. No. 201880097056.X, dated May 17, 2022.
National Institute of Industrial Property (Brazil), Office Action, with English translation, App. No. BR112021003069-7, dated Jul. 29, 2022.
China National Intellectual Property Administration, Office Action, with English translation, App. No. 201880097056.X, dated Mar. 25, 2022.
China National Intellectual Property Administration, Office Action, with English translation, App. No. 201880097056.X, dated Sep. 3, 2021.
European Patent Office, "Communication pursuant to Rules 161(1) and 162 EPC," App. No. 18792563.1, dated Apr. 9, 2021.
International Searching Authority: International Search Report and Written Opinion, Intl. App. No. PCT/RU2018/000578, dated Nov. 21, 2018.
National Institute of Industrial Property (Brazil), Office Action, with English translation, App. No. BR112021003069-7, dated Apr. 11, 2023.
European Patent Office, "Communication pursuant to Article 94(3) EPC," App. No. 18 792 563.1, dated Aug. 2, 2023.

* cited by examiner

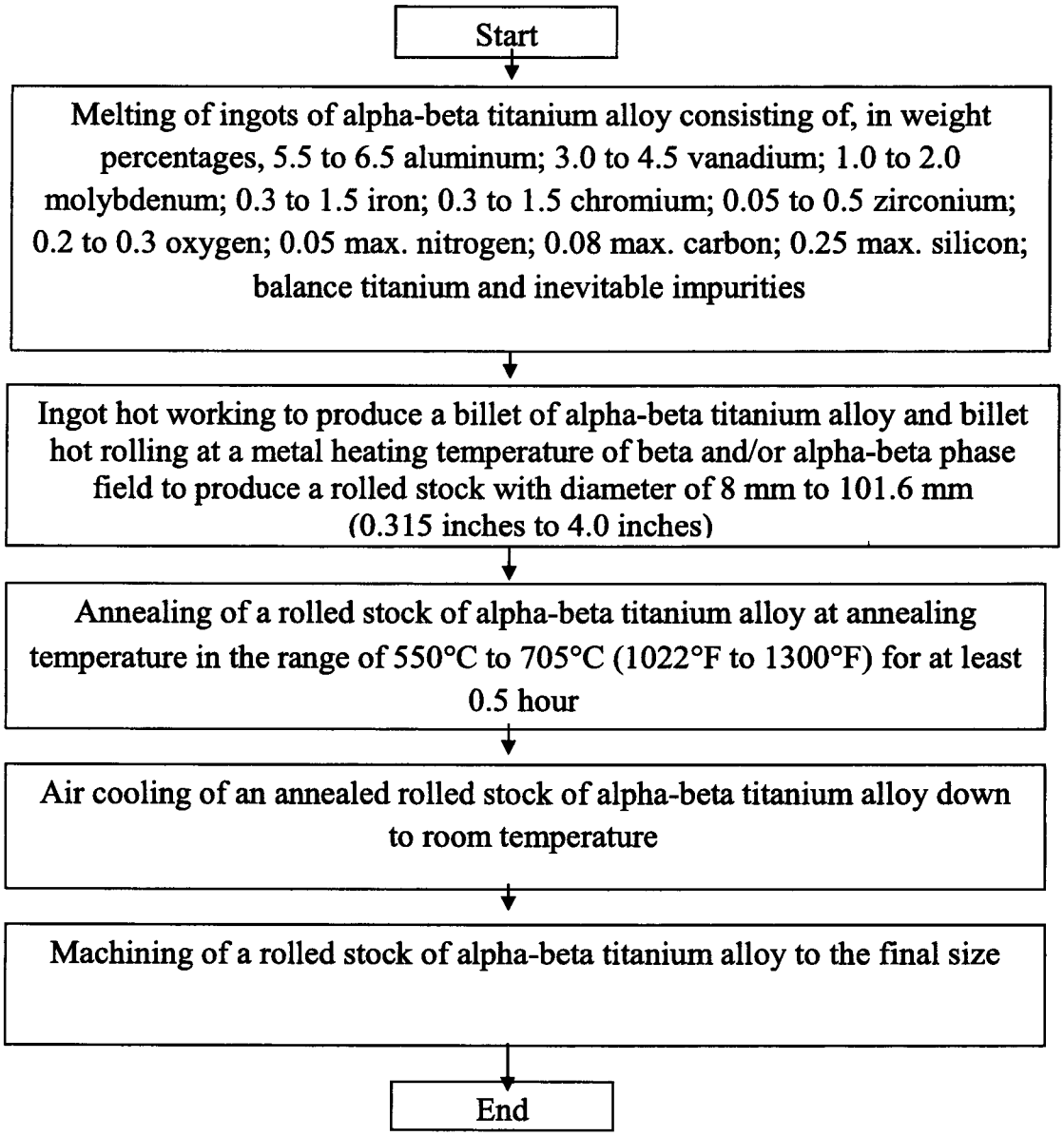
Fig. 1. PROCESS FLOW CHART FOR A BAR STOCK FOR HIGH STRENGTH FASTENERS MADE OF WROUGHT TITANIUM ALLOY

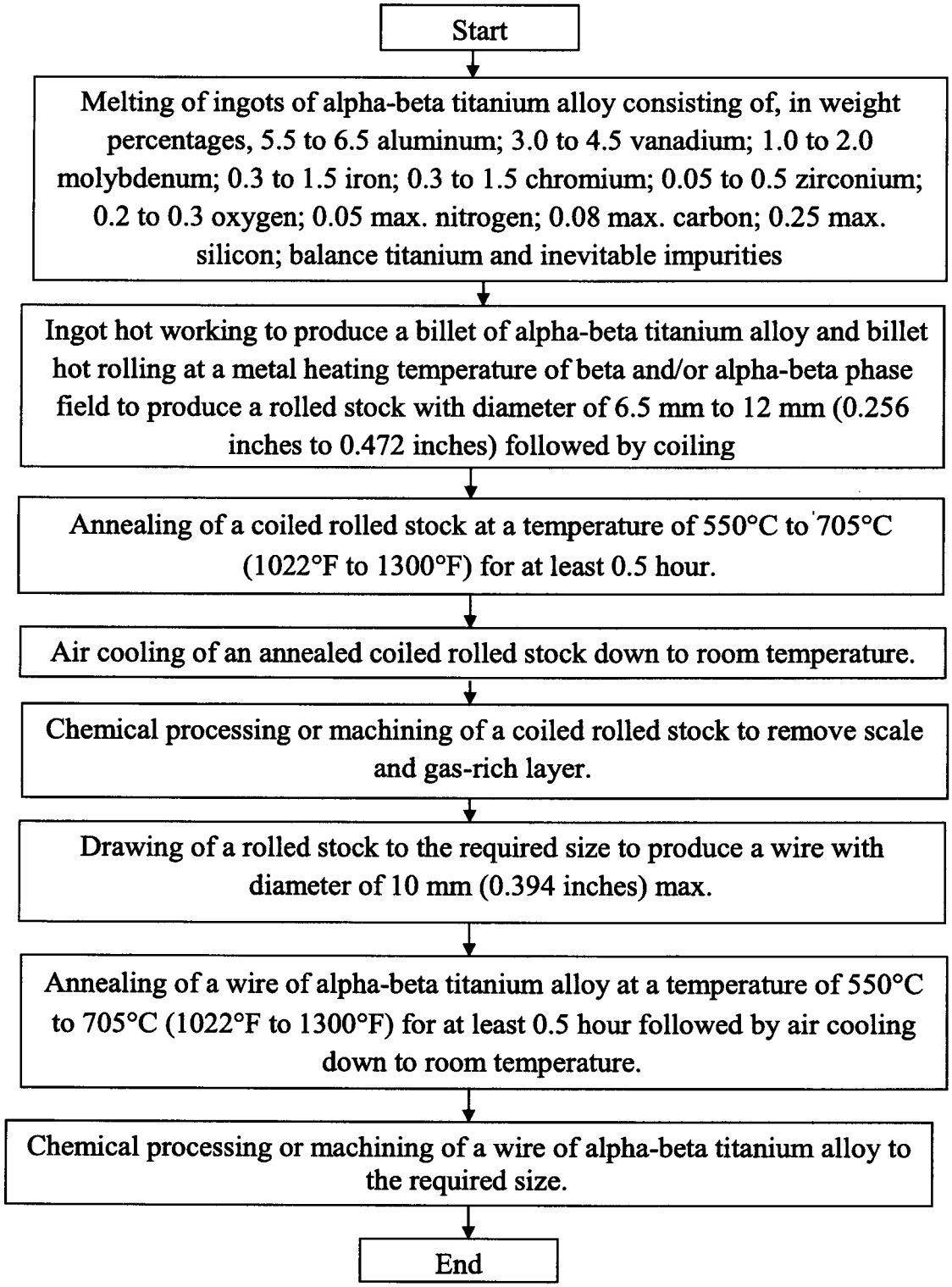
Fig. 2. PROCESS FLOW CHART FOR A HIGH STRENGTH FASTENER STOCK IN THE FORM OF A ROUND WIRE MADE OF WROUGHT TITANIUM ALLOY

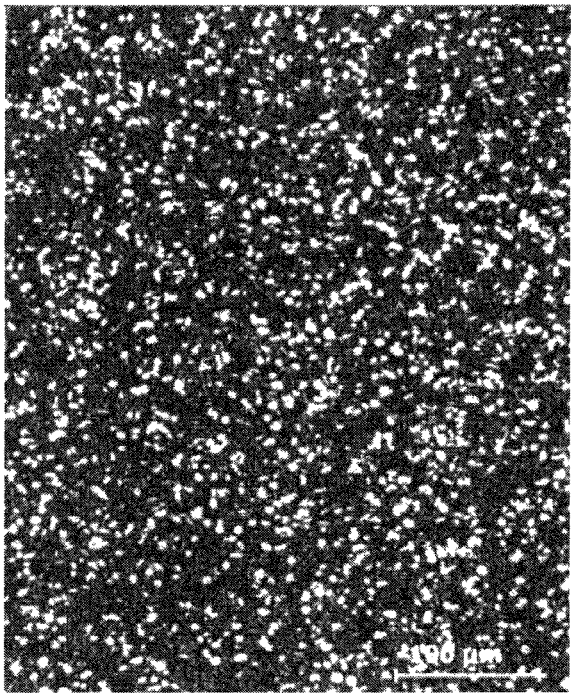
Fig. 3. MICROSTRUCTURE OF A BAR STOCK,
DIAMETER 12.7 MM (0.5 INCHES)

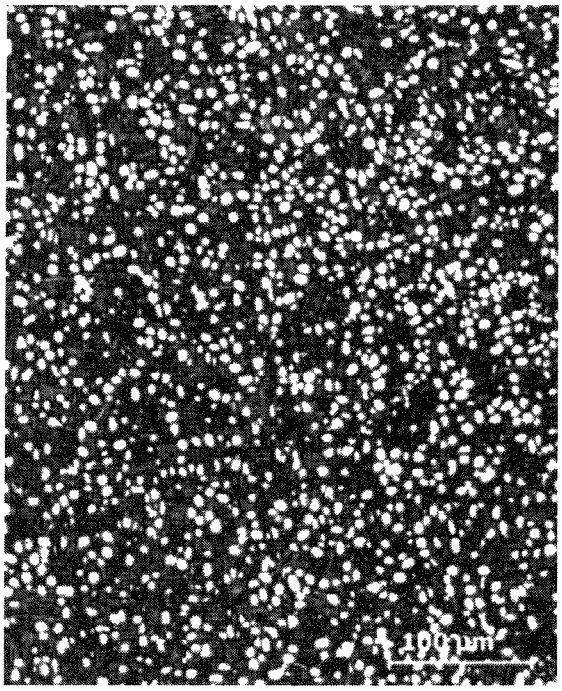
Fig. 4. MICROSTRUCTURE OF A BAR STOCK,
DIAMETER 101.6 MM (4 INCHES)

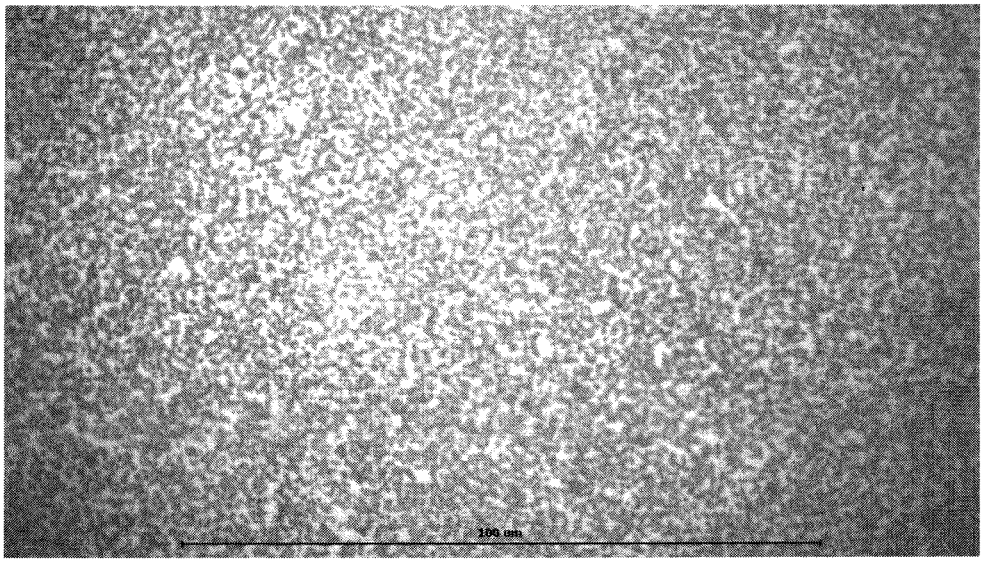
Fig. 5. MICROSTRUCTURE OF A WIRE,
DIAMETER 5.18 MM (0.204 INCHES)

HIGH STRENGTH FASTENER STOCK OF WROUGHT TITANIUM ALLOY AND METHOD OF MANUFACTURING THE SAME

This application is the U.S. national phase entry of Intl. Pat. App. No. PCT/RU2018/000578 filed on Aug. 31, 2018.

BACKGROUND

Aircraft engineering is one of the most complex domains of modern high-tech machine building and is characterized by certain peculiarities. Unique features of design, development, and production are defined by a huge number of different manufacturing processes for parts made of various materials in the airframe structure. The aircraft as a vehicle must ensure flight safety, reliability, and must also meet certain performance requirements. Quality and efficiency are key features of any aircraft. The aircraft design is a combination of assemblies and modules joined by fasteners. The number of fasteners in modern wide body passenger aircrafts can be as high as several hundred thousands. Flight safety depends on the quality and performance of structural fasteners. This is the reason why manufacture of fasteners requires a special approach.

To achieve the maximum flight performance and durability, bolts, screws, studs, rivets, and nuts are made of dedicated materials. Material of fasteners to be used in the airframe structure is selected based on assembly application and operating conditions. Traditionally, materials used for fastener manufacturing are resistant to temperature changes and impact stresses. Titanium alloys play a role in the manufacture of fasteners. Desired advantages of titanium fasteners over other types of fasteners include their high strength-to-weight ratio and elevated temperature stability in combination with high corrosion resistance. The above characteristics of titanium fasteners offer great opportunities for their application in the aircraft engineering.

The development and manufacture of competitive high-life materials for the fastener application are of particular importance and relevancy in the market economy environment. A special attention shall be paid to the assurance of high quality of a fastener stock while ensuring high output and minimized costs of fastener high-volume and large-scale production.

There is a known manufacturing method for fasteners of alpha-beta titanium alloy, which includes hot rolling, solution heat treatment and aging of alpha-beta titanium alloy consisting of, in weight percentages:

3.9 to 4.5 aluminum;
2.2 to 3.0 vanadium;
1.2 to 1.8 iron;
0.24 to 0.3 oxygen;
0.08 max. carbon;
0.05 max. nitrogen;
0.3 max. other elements (total), wherein other elements are, in fact, at least either boron, yttrium, each having concentration less than 0.005 or tin, zirconium, molybdenum, chromium, nickel, silicon, copper, niobium, tantalum, manganese, cobalt, each having concentration of 0.1 or less, the balance is titanium and inherent impurities; hot rolling of titanium alloy in alpha-beta phase field to produce a stock; annealing of the produced stock at a temperature of 1200° F. (648.9° C.) to 1400° F. (760° C.) for 1 to 2 hours; air cooling; machining to the specified product size; solution heat treatment at a temperature of 1500° F. (815.6° C.) to 1700° F. (926.7° C.) for 0.5 to 2 hours; cooling at a rate at least equivalent to cooling in the air; aging at a temperature of 800° F. (426.7° C.) to 1000° F. (537.8° C.) for 4 to 16 hours; and air cooling (RF patent of invention No. 2581332, IPC C22C 14/00, C22F 1/18, published on 20 Apr. 2016).

Use of the known solution enables production of fasteners and fastener stock with tensile strength above 190 ksi (1310 MPa), as well as achievement of double shear strength above 120 ksi (827 MPa). However, these mechanical properties can be only obtained in the as-solution heat treated and subsequently artificially aged (STA) condition, which results in the maximum strength with a certain reduction in plasticity. However, the strength above 160 ksi (1103 MPa) of these fasteners and fastener stock in the STA condition is only achievable for thicknesses up to 2.5 inches to 3 inches (63.5 mm to 76.2 mm) Moreover, the STA treatment causes an increase in the internal residual stresses in a fastener stock material, which requires straightening of long fasters. The internal residual stresses exceeding the design values lead to distortion of the shape and dimensions of the part during its production or operation. Herewith the residual stresses in the part material can present a certain threat, since they are added to the operating stresses affecting the part, which can reduce the part service life and lead to a premature failure of the structure.

There is a known manufacturing method for a titanium alloy and fasteners for the aircraft application, which includes production of titanium alloy incorporating at least 50% of titanium scrap; annealing of titanium alloy; wherein titanium alloy consists of, in weight percentages, 5.50 to 6.75 aluminum, 3.50 to 4.50 vanadium, 0.25 to 0.50 oxygen, and 0.40 to 0.80 iron; and the manufacture of titanium alloy fastener for the aircraft application (RF patent for invention No. 2618016, IPC C22C 14/00, C22F 1/18, published on May 2, 2017)—prototype.

The use of the prototype enables achievement of tensile strength up to 160 ksi (1103 MPa) and double shear strength up to 95 ksi (655 MPa) of the annealed metal with a fastener thickness not exceeding 1 inch (25.4 mm) However, thicker fasteners are characterized by a reduction in the maximum tensile strength down to 150 ksi (1034 MPa) and double shear strength down to 90 ksi (621 MPa).

Embodiments include production of a fastener stock with diameter up to 4 inches (101.6 mm) with a high level of mechanical properties and minimized manufacturing costs.

A technical result disclosed herein is production of a titanium alloy fastener stock having chemistry effectively balanced with production capabilities and high ultimate tensile strength and double shear strength while maintaining a high level of plastic properties in the annealed condition.

DETAILED DESCRIPTION

This technical result is achieved with the help of a manufacturing method for a fastener stock of wrought titanium alloy containing, in weight percentages, 5.5 to 6.5 Al, 3.0 to 4.5 V, 1.0 to 2.0 Mo, 0.3 to 1.5 Fe, 0.3 to 1.5 Cr, 0.05 to 0.5 Zr, 0.2 to 0.3 O, 0.05 max. N, 0.08 max. C, 0.25 max Si, balance titanium and inevitable impurities, having the value of aluminum structural equivalent [Al] eq in the range of 7.5 to 9.0, and the value of molybdenum structural equivalent [Mo] eq in the range of 6.0 to 8.5, where the equivalents are defined by the following equations:

$$[Al]\ eq=[Al]+[O]\times 10+[Zr]/6;$$

$$[Mo]\ eq=[Mo]+[V]/1.5+[Cr]\times 1.25+[Fe]\times 2.5.$$

A fastener stock is made in the form of a round rolled bar with diameter of 8 mm to 31.75 mm (0.315 inches to 1.25 inches) and minimum tensile strength of 165 ksi (1138 MPa) and minimum double shear strength of 100 ksi (689 MPa) in the annealed condition. A fastener stock can be made in the form of a round rolled bar with diameter over 32 mm to 101.6 mm (1.25 inches to 4 inches) and minimum tensile strength of 160 ksi (1103 MPa) and minimum double shear strength of 95 ksi (655 MPa) in the annealed condition. A fastener stock can be also made in the form of a round wire with diameter up to 10 mm (0.394 inches) produced via drawing and having minimum tensile strength of 168 ksi (1158 MPa) and minimum double shear strength of 103 ksi (710 MPa) in the annealed condition.

This technical result is also achieved with the help of a manufacturing method for a fastener stock made in the form of a round rolled bar with diameter of 8 mm to 101.6 mm (0.315 inches to 4.0 inches), which includes melting of titanium alloy ingot consisting of, in weight percentages, 5.5 to 6.5 Al, 3.0 to 4.5 V, 1.0 to 2.0 Mo, 0.3 to 1.5 Fe, 0.3 to 1.5 Cr, 0.05 to 0.5 Zr, 0.2 to 0.3 O, 0.05 max. N, 0.08 max. C, 0.25 max. Si, balance titanium and inevitable impurities, having the value of aluminum structural equivalent [Al] eq in the range of 7.5 to 9.0, and the value of molybdenum structural equivalent [Mo] eq in the range of 6.0 to 8.5, where the equivalents are defined by the following equations:

$$[Al]\ eq=[Al]+[O]\times 10+[Zr]/6;$$

$$[Mo]\ eq=[Mo]+[V]/1.5+[Cr]\times 1.25+[Fe]\times 2.5;$$

conversion of the ingot to forged billet at beta and/or alpha-beta phase field temperatures, machining of forged billets, hot rolling at a heating temperature of beta and/or alpha-beta phase field to produce a round stock, subsequent annealing of a rolled stock at a temperature of 550° C. to 705° C. (1022° F. to 1300□F) for at least 0.5 hour. Herewith a manufacturing method for a fastener stock made in the form of a round wire with diameter up to 10 mm (0.394 inches) produced via drawing, includes melting of titanium alloy ingot consisting of, in weight percentages, 5.5 to 6.5 Al, 3.0 to 4.5 V, 1.0 to 2.0 Mo, 0.3 to 1.5 Fe, 0.3 to 1.5 Cr, 0.05 to 0.5 Zr, 0.2 to 0.3 O, 0.05 max. N, 0.08 max C, 0.25 max Si, balance titanium and inevitable impurities, having the value of aluminum structural equivalent [Al] eq in the range of 7.5 to 9.0, and the value of molybdenum structural equivalent [Mo] eq in the range of 6.0 to 8.5, where the equivalents are defined by the following equations:

$$[Al]\ eq=[Al]+[O]\times 10+[Zr]/6;$$

$$[Mo]\ eq=[Mo]+[V]/1.5+[Cr]\times 1.25+[Fe]\times 2.5;$$

conversion of the ingot to forged billet at beta and/or alpha-beta phase field temperatures, machining of forged billets, hot rolling at a heating temperature of beta and/or alpha-beta phase field to produce a round stock with diameter of 6.5 mm to 12 mm (0.256 inches to 0.472 inches), subsequent annealing of a rolled stock at a temperature of 550° C. to 705° C. (1022° F. to 1300□F) for at least 0.5 hour followed by drawing to produce a wire and wire annealing at a temperature of 550□C to 705□C (1022□F to 1300□F) for at least
0.5 hour.

The proposed fastener stock demonstrates a combination of high processing and structural properties, which is achieved by optimal selection of alloying elements, their ratios in titanium alloy, and also by optimized parameters of thermomechanical treatment enabling production of a high quality fastener stock.

A fastener stock is made of, in embodiments, an alpha-beta titanium alloy containing alpha stabilizers, neutral strengtheners, and beta stabilizers.

A group of alpha stabilizers is formed of the elements such as aluminum and oxygen. The introduction of alpha stabilizers into titanium alloys expands the range of titanium solid solutions, reduces the density and improves the modulus of elasticity of the alloy. Aluminum is the most efficient strengthener which increases strength-to-weight ratio of the alloy, while improving the strength and high temperature behavior of titanium. When aluminum concentration in the alloy is less than 5.5%, the required strength is not achieved, while concentration exceeding 6.5% leads to an undesirable decrease in plasticity with a significant increase of BTT. Oxygen increases the temperature of titanium allotropic transformation. Presence of oxygen in the range of 0.2% to 0.3% increases the strength without plasticity deterioration. Presence of nitrogen in the alloy in concentrations not exceeding 0.05% and carbon in concentrations not exceeding 0.08% has no significant effect on the decrease in plasticity at room temperature.

Neutral strengtheners in the fastener stock chemistry include zirconium. Zirconium forms a wide range of solid solutions with alpha titanium, has similar melting point and density and improves corrosion resistance. Concentration of zirconium taken in the range of 0.05% to 0.5% enhances the tendency of strength increase due to the improved strength of alpha phase and effective influence on the maintenance of metastable state when cooling a stock of a heavier cross section.

A group of beta stabilizers disclosed herein and widely used in commercial alloys consists of isomorphous beta stabilizers and eutectoid beta stabilizers.

Chemistry of a fastener stock consists of isomorphous beta stabilizers, such as vanadium and molybdenum. Concentration of vanadium in the range of 3.0% to 4.5% ensures stabilization of beta phase, i.e. it hinders formation of alpha2 superstructure in alpha phase and contributes to the improvement of both strength and plastic properties. Concentration of molybdenum in the range of 1.0% to 2.0% ensures its complete solubility in alpha phase, which results in a high level of strength properties without deterioration of plastic properties. When molybdenum concentration exceeds 2.0%, the alloy specific gravity increases, while the alloy strength-to-weight ratio and plastic properties decrease.

The fastener stock chemistry is also presented by eutectoid beta stabilizers (Cr, Fe, Si).

Addition of iron in the range of 0.3% to 1.5% increases the volume fraction of beta phase, reducing the strain resistance during hot working of the alloy, which helps to prevent defects of hot working origin. The concentration of iron over 1.5% leads to segregation processes with formation of beta flecks during the alloy melting and solidification, which lead to inhomogeneity of structure and mechanical properties, as well as to deterioration of corrosion resistance.

Chromium concentration is established in the range of 0.3% to 1.5% due to this element's capability to strengthen titanium alloys well and act as a strong beta stabilizer. However, there is a high probability of forming embrittling intermetallics at long isothermal exposures and chemical inhomogeneities during ingot melting when alloying with chromium exceeds the established maximum limit.

The concentration of silicon is accepted at 0.25% maximum, since silicon in the specified limits completely dissolves in alpha phase, providing for strengthening of alpha solid solution and formation of a small amount of beta phase in the alloy. Moreover, addition of silicon to the alloy increases its high temperature stability. The concentrations of silicon exceeding the above limit result in formation of silicides, which lead to reduction in creep strength and material cracking.

The alloys herein are based on the possibility of separating the effects of titanium alloy strengthening via alloying with alpha stabilizers and neutral strengtheners and addition of beta stabilizers. This possibility is justified by the following considerations. Elements equivalent to aluminum strengthen titanium alloys mainly as a result of solution strengthening, while beta stabilizers strengthen titanium alloys mainly as a result of the increased amount of stronger beta phase. Therefore, in order to stabilize the strength properties of a fastener stock, there were marginal concentrations of alloying elements established. For this purpose there was a mechanism defined for control of their ratios within the ranges of the claimed composition of a fastener stock.

Structural aluminum ($[Al]_{eq}$) and molybdenum ($[Mo]_{eq}$) equivalents governed by economic, strength and processing criteria were calculated for the alloy used to make a fastener stock.

The structural aluminum equivalent $[Al]_{eq}$ is set in the range of 7.5 to 9.0. This limitation is explained by the fact that the value of $[Al]_{eq}$ below 7.5 does not ensure the required consistency of mechanical properties, and the value of $[Al]_{eq}$ over 9.0 leads to the increase in solid solution strengthening which deteriorates plastic behavior and creates prerequisites for cracking during hot working.

The value of the structural molybdenum equivalent $[Mo]_{eq}$ is taken in the range of 6.0 to 8.5, which ensures stabilization of the required amount of beta phase, phase changes upon thermal exposure to obtain a high level of strength properties of the alloy.

$[Al]_{eq}$ and $[Mo]_{eq}$ disclosed herein are the baseline categories that are established, controlled and that efficiently manage the manufacturing process to ensure a high quality fastener stock precisely meeting the customer requirements for structural and processing characteristics. The principles disclosed herein enable make-up of the deficiency in more expensive chemical elements by equivalent amounts of available less expensive alloying elements within the assigned strength equivalents and alloy chemical composition, including those alloying elements that are contained in certain amounts in the incorporated scrap. At the same time, the cost of the alloy can be reduced by 30% with stable preservation of high structural and operational properties of a fastener stock.

The essence of the proposed manufacturing method for a fastener stock is as follows.

The fastener stock is produced from the ingot melted in a vacuum arc furnace and having the following chemical composition: 5.5 to 6.5 Al, 3.0 to 4.5 V, 1.0 to 2.0 Mo, 0.3 to 1.5 Fe, 0.3 to 1.5 Cr, 0.05 to 0.5 Zr, 0.2 to 0.3 O, max. 0.05 N, max 0.08 C, max. 0.25 Si, balance titanium and inevitable impurities, and the value of structural aluminum equivalent [Al] eq in the range of 7.5 to 9.5, and the value of structural molybdenum equivalent [Mo] eq in the range of 6.0 to 8.5, where the equivalents are defined by the following equations:

$$[Al]\ eq=[Al]+[O]\times 10+[Zr]/6;$$

$$[Mo]\ eq=[Mo]+[V]/1.5+[Cr]\times 1.25+[Fe]\times 2.5.$$

Further, the ingot is converted to a forging stock (billet) at temperatures of beta and/or alpha-beta phase field which helps to eliminate the as-cast structure and prepare the metal structure for subsequent rolling, i.e. to produce a billet with the equiaxed macrograin. To completely remove a gas-rich layer and surface defects of hot working origin, the forging stock is machined. Hot rolling of a machined billet is carried out at a heating temperature of beta and/or alpha-beta phase field. Subsequent annealing of a rolled billet at a temperature of 550° C. to 705° C. (1022° F. to 1300° F.) for at least 0.5 hour with cooling down to room temperature is performed to obtain a more equilibrium structure and to lower the internal stresses. Machining of rolled billets is done to remove the scale and gas-rich layer. A process flow chart for a fastener stock in the form of a rolled bar is shown in FIG. 1

FIG. 2 shows a process flow chart for a fastener stock in the form of a wire. The manufacturing method for a wire, as well as the manufacturing method for a fastener stock in the form of a rolled bar, includes vacuum arc melting of an ingot, manufacture of a forging stock (billet), rolling of a machined billet at a metal heating temperature of beta and/or alpha-beta phase field. Rolling is performed to produce a rolled stock with diameter of 6.5 mm to 12 mm (0.256 inches to 0.472 inches) for its subsequent coiling. To remove the internal stresses, coils are annealed at a temperature of 550□C to 705° C. (1022□F to 1300° F.), followed by cooling down to room temperature.

To remove the scale and gas-rich layer, the coils of a rolled fastener stock are subjected to chemical processing or machining After that the rolled stock is drawn to produce a wire with diameter up to 10 mm (0.394 inches).

To remove the internal stresses and improve the structural equilibrium, as well as to enhance the plastic properties, the produced wire is annealed at a temperature of 550□C to 705° C. (1022□F to 1300° F.) with subsequent air cooling. The annealed wire is either chemically processed or machined to the fastener size.

Example 1. To test the industrial applicability of embodiments herein, the ingot with the chemical composition shown in Table 1 was melted. The beta transus temperature was 998° C. (1828° F.).

TABLE 1

| Sampling area | Concentration of elements, wt. % | | | | | | | | | | | Values of structural equivalents |
|---|---|---|---|---|---|---|---|---|---|---|---|---|
| | Al | V | Mo | Fe | Cr | Zr | O | N | C | Si | | |
| Ingot top | 5.96 | 3.72 | 1.64 | 0.77 | 0.69 | 0.1 | 0.25 | 0.002 | 0.039 | 0.022 | Balance - titanium and inevitable impurities | [Al]eq = 8.5<br>[Mo]eq = 7.0 |
| Ingot bottom | 6.01 | 3.80 | 1.60 | 0.82 | 0.71 | 0.1 | 0.24 | 0.002 | 0.047 | 0.017 | | [Al]eq = 8.4<br>[Mo]eq = 7.1 |

The ingot was converted to forged billets at temperatures of beta and alpha-beta phase fields. Billets were rolled to produce a fastener stock with diameter of 12.7 mm (0.5 inches) at a temperature of final rolling operation of 915° C. (1679□F). The rolled fastener stock was annealed at a temperature of 600° C. (1112□F) for 60 minutes with air cooling down to room temperature. After that mechanical tests and structure examination were performed. The results of mechanical tests of a fastener stock with diameter of 12.7 mm (0.5 inches) after heat treatment are given in Table 2, the microstructure of the heat treated stock at magnification 200× is shown in FIG. 3.

TABLE 2

| | Tensile properties | | | | Double shear |
|---|---|---|---|---|---|
| Specimen number | Yield strength, ksi (MPa) | Ultimate tensile strength, ksi (MPa) | Elongation, % | Reduction of area, % | strength, ksi (MPa) |
| 1 | 168.3 (1160) | 179.2 (1236) | 15.3 | 56.6 | 114.2 (787) |
| 2 | 170.7 (1177) | 181.8 (1254) | 16.3 | 59.0 | 113.5 (783) |

Example 2. To produce a fastener stock with diameter of 101.6 mm (4 inches), the ingot with the chemical composition shown in Table 3 was melted. The alloy beta transus temperature (BTT) determined by metallographic method was 988° C. (1810° F.).

TABLE 3

| Sampling | Concentration of elements, wt. % | | | | | | | | | | | Values of structural |
|---|---|---|---|---|---|---|---|---|---|---|---|---|
| area | Al | V | Mo | Fe | Cr | Zr | O | N | C | Si | | equivalents |
| Ingot top | 5.74 | 3.84 | 1.60 | 0.72 | 0.69 | 0.10 | 0.26 | 0.006 | 0.040 | 0.018 | Balance - titanium and inevitable impurities | [Al]eq = 8.36<br>[Mo]eq = 6.82 |
| Ingot bottom | 5.74 | 3.84 | 1,59 | 0.72 | 0.70 | 0.11 | 0.25 | 0.006 | 0.038 | 0.019 | | [Al]eq = 8.26<br>[Mo]eq = 6.83 |

The ingot was converted to forged billets at temperatures of beta and alpha-beta phase fields. Billets were rolled to produce a fastener stock with diameter of 101.6 mm (4 inches) at a temperature of 918° C. (1685□F). The test coupons of the rolled fastener stock with diameter of 101.6 mm (4 inches) and length of 101.6 mm (4 inches) were annealed at a temperature of 600° C. (1112□F) for 60 minutes. After that mechanical tests in longitudinal direction and structure examination were performed. The results of mechanical tests of a fastener stock with diameter of 101.6 mm (4 inches) after heat treatment are given in Table 4, the microstructure of a fastener stock at magnification 200× is shown in FIG. 4.

TABLE 4

| | Tensile properties | | | | Double shear |
|---|---|---|---|---|---|
| Specimen number | Yield strength, ksi (MPa) | Ultimate tensile strength, ksi (MPa) | Elongation, % | Reduction of area, % | strength, ksi (MPa) |
| 1 | 149.1 (1028) | 163.3 (1126) | 15.3 | 48.3 | 104.6 (721) |
| 2 | 149.5 (1031) | 162.5 (1121) | 16.0 | 52.2 | 106.6 (735) |

Example 3. To produce a fastener stock in the form of a wire with diameter of 5.18 mm (0.204 inches), the ingot with the chemical composition shown in Table 5 was melted. The alloy beta transus temperature (BTT) determined by metallographic method was 988° C. (1810□F).

TABLE 5

| Sampling area | Concentration of elements, wt. % | | | | | | | | | | | Values of structural equivalents |
|---|---|---|---|---|---|---|---|---|---|---|---|---|
| | Al | V | Mo | Fe | Cr | Zr | O | N | C | Si | | |
| Ingot top | 5.74 | 3.84 | 1.60 | 0.72 | 0.69 | 0.10 | 0.26 | 0.006 | 0.040 | 0.018 | Balance - titanium and inevitable impurities | [Al]eq = 8.36<br>[Mo]eq = 6.82 |
| Ingot bottom | 5.74 | 3.84 | 1.59 | 0.72 | 0.70 | 0.11 | 0.25 | 0.006 | 0.038 | 0.019 | | [Al]eq = 8.26<br>[Mo]eq = 6.83 |

The ingot was converted to forged billets at temperatures of beta and alpha-beta phase fields. Billets were rolled to produce a fastener stock with diameter of 101.6 mm (4 inches) at a temperature of 918° C. (1685□F). The rolled stock with diameter of 101.6 mm (4 inches) was rolled to a stock with diameter of 7.92 mm (0.312 inches) with the end of hot working in alpha-beta phase field. The rolled stock with diameter of 7.92 mm (0.312 inches) was degassed in a vacuum furnace and then drawn via several stages to produce a wire with diameter of 6.07 mm (0.239 inches). The wire was annealed under the following conditions: heating to 705□C (1300□F), soaking for 1 hour, air cooling. Wire grinding and polishing were followed by blasting and pickling. After that, the wire was lubed and sized to diameter of 5.18 mm (0.204 inches). The results of mechanical tests of a wire with diameter of 5.18 mm (0.204 inches) after annealing are given in Table 6. The microstructure of a wire at magnification 800× is shown in FIG. 5.

TABLE 6

| Specimen number | Tensile properties | | | | Double shear strength, ksi (MPa) |
|---|---|---|---|---|---|
| | Yield strength, ksi (MPa) | Ultimate tensile strength, ksi (MPa) | Elongation, % | Reduction of area, % | |
| 1 | 164 (1131) | 190 (1310) | 21 | 58 | 111 (765) |
| 2 | 160 (1103) | 188 (1296) | 18 | 57 | 110 (758) |

Thus, the claimed invention enables production of a fastener stock with thickness as high as 101.6 mm (4 inches), and also allows the use of stock in the form of a wire for additive manufacturing, with a high level of strength properties and double shear strength while maintaining a high level of plastic properties.

The invention claimed is:

1. A fastener stock in the form of a round rolled bar or a drawn round wire, the fastener stock comprising wrought titanium alloy consisting essentially of, in weight percentages: 5.5 to 6.5 Al, 3.0 to 4.5 V, 1.0 to 2.0 Mo, 0.9 to 1.5 Fe, 0.8 to 1.5 Cr, 0.05 to 0.5 Zr, 0.2 to 0.3 O, 0.05 max. N, 0.08 max. C, 0.25 max. Si, and balance titanium and inevitable impurities, characterized by the value of aluminum structural equivalent [Al] eq in the range of 8.2 to 9.5, and the value of molybdenum structural equivalent [Mo] eq in the range of 6.0 to 8.5, where the equivalents are defined by the following equations:

[Al] eq=[Al]+[O]×10+[Zr]/6, wherein [Al], [O], and [Zr] are the weight percentages of aluminum, oxygen, and zirconium, respectively;

[Mo] eq=[Mo]+[V]/1.5+[Cr]×1.25+[Fe]×2.5, wherein [Mo], [V], [Cr], and [Fe] are the weight percentages of molybdenum, vanadium, chromium and iron, respectively.

2. The fastener stock comprising the wrought titanium alloy of claim 1 in the form of the round rolled bar with diameter of 8 mm to 31.75 mm (0.315 inches to 1.25 inches).

3. The fastener stock comprising the wrought titanium alloy of claim 1 in the form of the round rolled bar with diameter over 31.75 mm to 101.6 mm (1.25 inches to 4.0 inches).

4. The fastener stock comprising the wrought titanium alloy of claim 1 made in the form of the drawn round wire with diameter up to 10 mm (0.394 inches).

5. The fastener stock in accordance with claim 1 having ultimate tensile strength in the annealed condition of 165 ksi (1138 MPa) minimum.

6. The fastener stock in accordance with claim 1 having double shear strength in the annealed condition of 100 ksi (689 MPa) minimum.

7. The fastener stock in accordance with claim 1 having ultimate tensile strength in the annealed condition of 160 ksi (1103 MPa) minimum.

8. The fastener stock in accordance with claim 1 having double shear strength in the annealed condition of 95 ksi (655 MPa) minimum.

9. The fastener stock in accordance with claim 1 having ultimate tensile strength in the annealed condition of 168 ksi (1158 MPa) minimum.

10. The fastener stock in accordance with claim 1 having double shear strength in the annealed condition of 103 ksi (710 MPa) minimum.

11. A manufacturing method for the fastener stock in accordance with claim 1 which includes melting of titanium alloy ingot consisting of, in weight percentages: 5.5 to 6.5 Al, 3.0 to 4.5 V, 1.0 to 2.0 Mo, 0.9 to 1.5 Fe, 0.8 to 1.5 Cr, 0.05 to 0.5 Zr, 0.2 to 0.3 O, 0.05 max. N, 0.08 max. C, 0.25 max. Si, and balance titanium and inevitable impurities, characterized by the value of aluminum structural equivalent [Al] eq in the range of 8.2 to 9.5, and the value of molybdenum structural equivalent [Mo] eq in the range of 6.0 to 8.5, where the equivalents are defined by the following equations:

[Al] eq=[Al]+[O]×10+[Zr]/6;

[Mo] eq=[Mo]+[V]/1.5+[Cr]×1.25+[Fe]×2.5, conversion of the ingot to a forged billet at beta and/or alpha-beta phase field temperatures, machining of forged billets, hot rolling at a heating temperature of beta and/or alpha-beta phase field to produce the round rolled bar, subsequent annealing of the round rolled bar at a temperature of 550° C. to 705° C. (1022° F. to 1300° F.) for at least 0.5 hour.

12. A manufacturing method for the fastener stock in accordance with claim 1 which includes melting of titanium alloy ingot consisting of, in weight percentages: 5.5 to 6.5 Al, 3.0 to 4.5 V, 1.0 to 2.0 Mo, 0.9 to 1.5 Fe, 0.8 to 1.5 Cr, 0.05 to 0.5 Zr, 0.2 to 0.3 O, 0.05 max. N, 0.08 max. C, 0.25 max. Si, and balance titanium and inevitable impurities, characterized by the value of aluminum structural equivalent [Al] eq in the range of 8.2 to 9.5, and the value of molybdenum structural equivalent [Mo] eq in the range of 6.0 to 8.5, where the equivalents are defined by the following equations:

$$[Al]\ eq=[Al]+[O]\times 10+[Zr]/6;$$

$$[Mo]\ eq=[Mo]+[V]/1.5+[Cr]\times 1.25+[Fe]\times 2.5,$$

conversion of the ingot to forged billet at beta and/or alpha-beta phase field temperatures, machining of forged billets, hot rolling at a heating temperature of beta and/or alpha-beta phase field to produce a rolled stock with diameter of 6.5 mm to 12 mm (0.256 inches to inches), subsequent annealing of a rolled stock at a temperature of 550° C. to 705° C. (1022° F. to 1300° F.) for at least 0.5 hour followed by drawing to produce the drawn round wire with diameter up to 10 mm (0.394 inches) and subsequent annealing at a temperature of 550° C. to 705° C. (1022° F. to 1300° F.) for at least 0.5 hour.

13. A manufacturing method using the fastener stock in accordance with claim 1 which includes producing a fastener from the fastener stock.

14. A fastener produced using the fastener stock in accordance with claim 1.

15. The fastener stock of claim 1, wherein the iron content is 1.0 to 1.5 in weight percentage.

16. The fastener stock of claim 1, wherein the zirconium content is 0.2 to 0.5 in weight percentage.

17. The fastener stock of claim 1, wherein the aluminum content is 5.6 to 6.5 in weight percentage.

18. The fastener stock of claim 1, wherein the aluminum content is 5.7 to 6.5 in weight percentage.

19. A fastener stock in the form of a round rolled bar or a drawn round wire, the fastener stock comprising wrought titanium alloy consisting essentially of, in weight percentages: 5.5 to 6.5 Al, 3.0 to 4.5 V, 1.0 to 2.0 Mo, 0.9 to 1.5 Fe, 0.8 to 1.5 Cr, 0.05 to 0.5 Zr, 0.2 to 0.3 O, 0.05 max. N, 0.08 max. C, 0.25 max. Si, and balance titanium and inevitable impurities, characterized by the value of aluminum structural equivalent [Al] eq in the range of 8.2 to 9.5 and the value of molybdenum structural equivalent [Mo] eq in the range of 6.0 to 7.1, where the equivalents are defined by the following equations:

[Al] eq=[Al]+[O]×10+[Zr]/6, wherein [Al], [O], and [Zr] are the weight percentages of aluminum, oxygen, and zirconium, respectively;

[Mo] eq=[Mo]+[V]/1.5+[Cr]×1.25+[Fe]×2.5, wherein [Mo], [V], [Cr], and [Fe] are the weight percentages of molybdenum, vanadium, chromium and iron, respectively.

20. A fastener produced using the fastener stock in accordance with claim 19.

* * * * *